US007645002B2

(12) United States Patent
Fitz

(10) Patent No.: US 7,645,002 B2
(45) Date of Patent: Jan. 12, 2010

(54) ARTICLE OF FURNITURE

(75) Inventor: Helmut Fitz, Lustenau (AT)

(73) Assignee: Julius Blum GmbH, Hochst (AT)

( * ) Notice: Subject to any disclaimer, the term of this patent is extended or adjusted under 35 U.S.C. 154(b) by 5 days.

(21) Appl. No.: 12/007,559

(22) Filed: Jan. 11, 2008

(65) Prior Publication Data

US 2008/0111455 A1 May 15, 2008

Related U.S. Application Data

(63) Continuation of application No. PCT/AT2006/000270, filed on Jun. 29, 2006.

(30) Foreign Application Priority Data

Jul. 12, 2005 (AT) ..... A 1167/2005

(51) Int. Cl.
*E05B 65/46* (2006.01)

(52) U.S. Cl. ..... 312/215; 312/222; 312/319.5

(58) Field of Classification Search ..... 312/215, 312/222, 330.1, 319.5–319.8
See application file for complete search history.

(56) References Cited

U.S. PATENT DOCUMENTS

| | | | | |
|---|---|---|---|---|
| 128,439 | A | 6/1872 | Unna | |
| 2,873,159 | A | 2/1959 | Becker | |
| 3,005,672 | A * | 10/1961 | Becker | 312/319.7 |
| 5,087,107 | A * | 2/1992 | Fumanelli | 312/333 |
| 5,158,347 | A * | 10/1992 | Warren et al. | 312/319.8 |
| 5,392,951 | A * | 2/1995 | Gardner et al. | 312/319.5 |
| 5,797,666 | A * | 8/1998 | Park | 312/319.5 |
| 6,059,390 | A * | 5/2000 | Salomaa | 312/348.3 |
| 6,789,860 | B1 * | 9/2004 | DePietro et al. | 312/319.8 |
| 7,331,643 | B2 * | 2/2008 | Huber et al. | 312/319.5 |
| 2004/0100169 | A1 | 5/2004 | Huber et al. | |
| 2005/0017611 | A1 * | 1/2005 | Katagiri | 312/319.5 |
| 2005/0269919 | A1 * | 12/2005 | Sambommatsu et al. | 312/319.5 |

FOREIGN PATENT DOCUMENTS

| | | |
|---|---|---|
| AT | 211 504 | 10/1960 |
| DE | 826 653 | 3/1952 |
| DE | 88 02 343 | 3/1988 |

(Continued)

OTHER PUBLICATIONS

International Search Report issued Nov. 27, 2006 in the International (PCT) Application of which the present application is the U.S. National Stage.

(Continued)

*Primary Examiner*—Hanh V Tran
(74) *Attorney, Agent, or Firm*—Wenderoth, Lind & Ponack, L.L.P.

(57) ABSTRACT

A piece of furniture with a furniture body and a first and at least one second drawer, displaceable relative to the furniture body, the front panel of the first drawer essentially completely covering the front panel or front wall of the second drawer in the closed position for both drawers, characterized in that the first and the at least one second drawer comprise an opening device for displacing the drawers from a closed position to an open position and a switch element is provided between both opening devices which couples both opening devices in a first switch position and uncouples the same in a second switch position.

14 Claims, 4 Drawing Sheets

FOREIGN PATENT DOCUMENTS

| | | | |
|---|---|---|---|
| DE | 297 01 227 | | 4/1997 |
| DE | 198 23 305 | | 12/1999 |
| DE | 100 35 447 | | 7/2003 |
| EP | 0538550 | * | 4/1993 |
| EP | 1 127 514 | | 8/2001 |
| EP | 1 323 364 | | 7/2003 |
| EP | 1 374 732 | | 1/2004 |
| FR | 2666729 | * | 3/1992 |
| FR | 2 770 169 | | 4/1999 |
| GB | 751838 | | 7/1956 |

OTHER PUBLICATIONS

Austrian Search Report issued Jan. 20, 2006 in the corresponding Austrian patent application.

* cited by examiner

ARTICLE OF FURNITURE

This application is a continuation of International Application No. PCT/AT2006/000270, filed Jun. 29, 2006.

BACKGROUND OF THE INVENTION

1. Field of the Invention

The present invention relates to an article of furniture comprising a furniture carcass and a first and at least one second drawer displaceable relative to the furniture carcass, wherein in the closed position of the two drawers the front panel of the first drawer substantially completely covers the front panel or the front wall of the second drawer.

2. Description of the Related Art

Items of furniture of that kind describe inter alia what are referred to as internal extension portions, the front panel or the front wall of which is disposed behind a larger or upwardly extended front panel of a front extension portion. When an internal extension portion is fitted into an article of furniture in the form of a cabinet, the front extension portion always has to be opened first so that the internal extension portion becomes accessible and can also be opened. Often those internal extension portions, for aesthetic reasons or reasons of space, do not have any handle or grip whereby the operating option is restricted. If, in addition, the internal extension portion is arranged directly beneath a transverse member, an intermediate panel portion or under additional internal extension portions, there is no comfortable and convenient possible way of opening the internal extension portion. If, moreover, the internal extension portion is provided with a closure mechanism, which in its closed position acts on the internal extension portion with a retaining force for keeping it closed, actuation is in addition impractical as the opening movement against a spring force is made considerably more difficult.

SUMMARY OF THE INVENTION

It is therefore an object of the present invention to propose an article of furniture of the general kind set forth in the opening part of this specification, which offers a user a high level of operating comfort.

In accordance with the invention in an advantageous configuration that is achieved in that the first and the at least one second drawer have an ejection device for moving the drawers from the closed position into an open position and that arranged between the two ejection devices is a switching element which couples the two ejection devices in a first switching position and uncouples them in a second switching position.

If the ejection device acts, for example, on the second drawer (internal extension portion), it can be conveniently moved into an open position without any need for the user to grip behind the internal extension portion for that purpose. If the ejection device acts on the first drawer (front extension portion), it can be selectively coupled to or not coupled to the internal extension portion, by a preferably mechanical coupling means.

In order to promote the ejection movement of the drawer it can also be provided that at least one ejection device has a drive device, preferably at least one spring or at least an electric motor, by which an ejection element is or can be acted upon for ejection of the drawer. In order to avoid the drawer abruptly springing open, it can also be desirable for the relative movement between the ejection device and the drawer or the guide rails thereof to be damped by means of a damping device.

An embodiment of the invention provides that the first drawer and the at least one second drawer have a separate ejection device for moving the drawers from a closed position into an open position. In that way the extension movements can be controlled independently of each other. An advantageous configuration provides in that respect that the ejection device of the first and the at least one second drawers are coupled so that the ejection device of the second drawer can be triggered by way of the ejection device of the first drawer. In that case, the at least two ejection devices can be electrically or mechanically coupled together so as to afford a very wide range of triggering and switching combinations. A configuration in that respect can be such that disposed between the two ejection devices is a switching element which couples the two ejection devices in a first switching position and uncouples them in a second switching position. In that case, the switching element can be either in the form of a mechanical switch or—in accordance with a further embodiment—it can be in the form of a logic circuit for interlinking digital signals in accordance with the rules of Boolean algebra.

A further embodiment of the invention provides that at least the first drawer has a first limit position which corresponds to the closed position of the first drawer and the first drawer is movable starting from that limit position by the application of pressure in the closing direction thereof into a second limit position which is further into the furniture carcass. In that case, the configuration can be such that an ejection device is of such a configuration that it moves the drawer from the second limit position into an open position. Fitments of that kind are known as touch-latch fitments which are actuated by the drawer being pushed in by a predetermined distance in order then to be moved into an open position by a force storage device (spring device, fluid damper, electric motor).

Alternatively or as a supplemental consideration, it may also be advantageous if the at least first drawer has a limit position which corresponds to the closed position of the drawer and the first drawer is movable starting from that limit position by applying a pulling force into an open position, wherein the ejection device is inactive. If the first drawer (front extension portion) is activated by way of a pulling pulse, in that case preferably only the front extension portion is extended as the ejection device of the internal extension portion does not receive a switching pulse. In that situation, the internal extension portion can selectively remain in the closed position or selectively be activated by manually applying pressure or a pulling force to the front panel thereof.

In accordance with a further embodiment of the invention it can be provided that the article of furniture has a control and/or a regulating device for selectively moving the drawers. In that case for example selective activation, the moment in time of actuation and/or the movements of the drawer can be controlled separately or in all possible combinations. In that connection, it may be desirable if the ejection device has at least one electric switch which is activatable by the application of a pulling force or a pushing force to the drawer, wherein the signals thereof can be passed to the control and/or regulating device. In that respect, the electric switch can be in the form of a microswitch, the switching pulses of which are passed to an address decoder for programmed actuation of the individual ejection devices. By way of example the arrangement can be such that the control and/or regulating device is so designed that it does not activate the ejection device of the at least second drawer (internal extension portion) when a pressure is preferably applied once to the first drawer (front extension portion). In other words, the internal extension portion, when pressure is applied once to the front panel of the front extension portion, is not extended while the front extension portion alone moves into the open position. A further embodiment can be such that the control and/or regulating device is so designed that it activates the ejection device of the at least second drawer (internal extension portion) when pressure is preferably applied twice in succession to the first drawer (front extension portion) within a predetermined or predeterminable period of time. In other words, in the case of a "double click" on the front extension portion, both the front extension portion and also the internal extension portion are moved into an open position. In an advantageous development it can also be provided that the control and/or regulating device is so designed that it does not activate the ejection device or devices when a pulling force is applied to the first drawer. It is to be noted in that respect that a very wide range of switching options are possible in this connection, for one of ordinary skill in the art dealing with this object.

In accordance with a preferred development of the invention it can be provided that the article of furniture has a releasable coupling device for temporarily coupling the two drawers. The additional arrangement of that releasable coupling device in combination with at least one ejection device for the drawer affords additional possible combinations. In that respect, it can be advantageous if the at least second drawer is movable at least from the completely closed position into an open position by the releasable coupling device. In this connection, it is desirable if the releasable coupling device has two or more, preferably preselectable, modes of operation. The possibility of adjusting the releasable coupling device can provide that for example the first drawer (front extension portion) can be opened, in which case in accordance with the two modes of operation it is possible selectively to establish whether the at least second drawer (internal extension portion) does or does not also perform the movement of the front extension portion. In that respect, it is advantageous if the releasable coupling device is arranged or designed in such a way that the drawers can be uncoupled, preferably in a common open position thereof, so that each drawer can be actuated in itself alone.

In regard to the releasable coupling device many different configurations can be implemented in a manner with which the man skilled in the art will be familiar. In an embodiment it can be provided that the releasable coupling device is preferably operative between the rear side of the front panel of the first drawer and between the front side of the front panel or front wall of the at least second drawer. In the simplest case it may be desirable if the releasable coupling device has a mechanical latching connection (for example at least one spring-loaded latching element).

An alternative embodiment can also provide that at least one, preferably spring-loaded, spring buffer and/or at least one spacer portion, preferably comprising a damping material, is or are arranged between the front panel of the first drawer and the front panel or front wall of the second drawer. That arrangement means that it is possible to effectively prevent hard impact of the front panel of the first drawer against the front panel or front wall of the second drawer so that the banging noises which occur in that case are substantially reduced.

Finally, in an embodiment of the invention it can be provided that at least one of the drawers has a retraction device by which the drawer is movable into the closed limit position, wherein preferably the last closing travel to the completely closed position thereof takes place in a damped fashion. In that respect, each drawer of the article of furniture can be equipped with a retraction device of that kind, which reliably move the drawers into the closed limit position. Usually, retraction devices of that kind are also provided with a damping device which damps the movement of the drawer over the last closing range so that it is not retracted into the carcass of the article of furniture with too much momentum. In that respect fluid dampers, for example linear or rotational dampers, can advantageously be used as the damping devices.

BRIEF DESCRIPTION OF THE DRAWINGS

Further details and advantages of the invention are described in greater detail hereinafter by means of the specific description with reference to the drawings in which.

DETAILED DESCRIPTION OF THE PREFERRED EMBODIMENT

Figure 1:
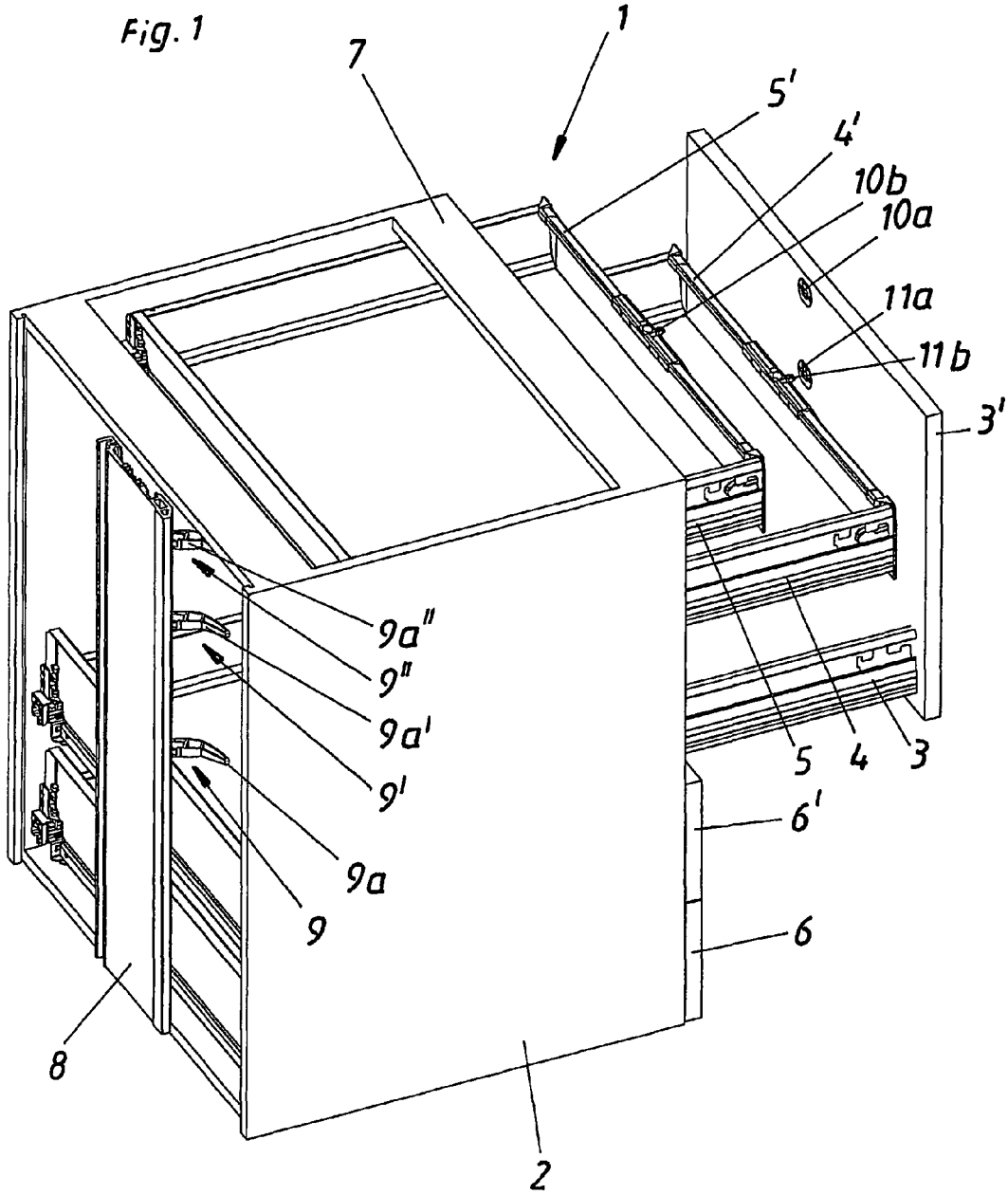
FIG. 1 shows a perspective view of an embodiment of an article of furniture according to the invention, wherein the article of furniture has a front extension portion and two internal extension portions disposed therebehind.

FIG. 1 shows an embodiment of an article of furniture 1 according to the invention as a perspective view. The article of furniture 1 which is in the form of a cabinet has a carcass 2 in which a first drawer 3 (front extension portion) with an upwardly extended front panel 3' is displaceable. Also, disposed in the carcass 2 are a second and a third drawer 4 and 5 (internal extension portions), the front walls 4' and 5' of which in the closed position of the drawers 3, 4, 5 are behind the upwardly extended front panel 3' of the front extension portion 3. In order to open the two internal extension portions 4 and 5, the front extension portion 3 always has to be opened first, which makes it more difficult to operate the drawers 3, 4 and 5. For that purpose provided on the rear wall 8 (only partially shown) of the article of furniture are three separate ejection devices 9, 9' and 9", the ejection elements 9*a*, 9*a'* and 9*a"* of which preferably act on the respective rear walls of the individual drawers 3, 4 and 5 so that the drawers 3, 4 and 5, starting from the closed position, are accelerated, overcoming the mass inertia thereof, so that the drawers 3, 4 and 5 can be moved into an open position. The ejection devices 9, 9' and 9" preferably include a spring device (not shown) or, in accordance with an alternative embodiment, at least one electrical drive unit so that a torque is applied to the respective ejection elements 9*a*, 9*a'* and 9*a"*. The rear wall of the respective drawers 3, 4 and 5 is suitable in particular for the force of the ejection elements 9*a*, 9*a'* and 9*a"* to act thereon, in which case the free ends of the ejection elements 9*a*, 9*a'* and 9*a"* bear in the closed limit position against the respective rear walls of the drawers 3, 4 and 5. In principle the ejection devices 9, 9' and 9" can also act at another location of the article of furniture, for example on the extension rails thereof which are disposed at both sides of the drawers 3, 4 and 5.

The separate ejection devices 9, 9' and 9" which in accordance with an embodiment of the invention can be coupled by at least one switching element afford various possible combinations which are described in greater detail in the Figures hereinafter. In order still further to enlarge the possible combinations of the drawers 3, 4 and 5, there are provided releasable coupling devices for selectively or temporarily coupling an internal extension portion 4, 5 to the front extension portion 3 so that, in an outward movement of the front extension portion 3, an internal extension portion 4, 5 also moves therewith or does not move therewith. The releasable coupling device includes substantially hook-shaped entrainment elements 10*b* and 11*b* respectively, and coupling elements 10*a* and 11*a*. The hook-shaped entrainment elements 10*b* and 11*b* are disposed in the region of the front walls 4' and 5' and can be releasably coupled to the coupling elements 10*a* and 11*a* of the front panel 3'. In that respect it may desirably be provided that the entrainment elements 10*b* and 11*b* and/or the coupling elements 10*a* and 11*a* have at least two operating positions, wherein in a first operating position the entrainment elements 10*b* and 11*b* automatically latch to the coupling element 10*a* and 11*a* respectively when the front extension portion 3 is brought together with the internal extension portions 4, 5 while in a second operating position no latching occurs between the entrainment elements 10*b* and 11*b* and the coupling elements 10*a* and 11*a*. In that connection, it is desirable if the entrainment element 10*b* and 11*b* respectively has an adjustment option by which the two operating positions can be activated, for example by manual actuation. That can be affected by either the entrainment elements 10*b* and 11*b* respectively, or the coupling elements 10*a* and 11*a* respectively, being adapted to be rotatable through 180° so that coupling is activated in one position and is deactivated in the position of being turned through 180°.

Figure 2:
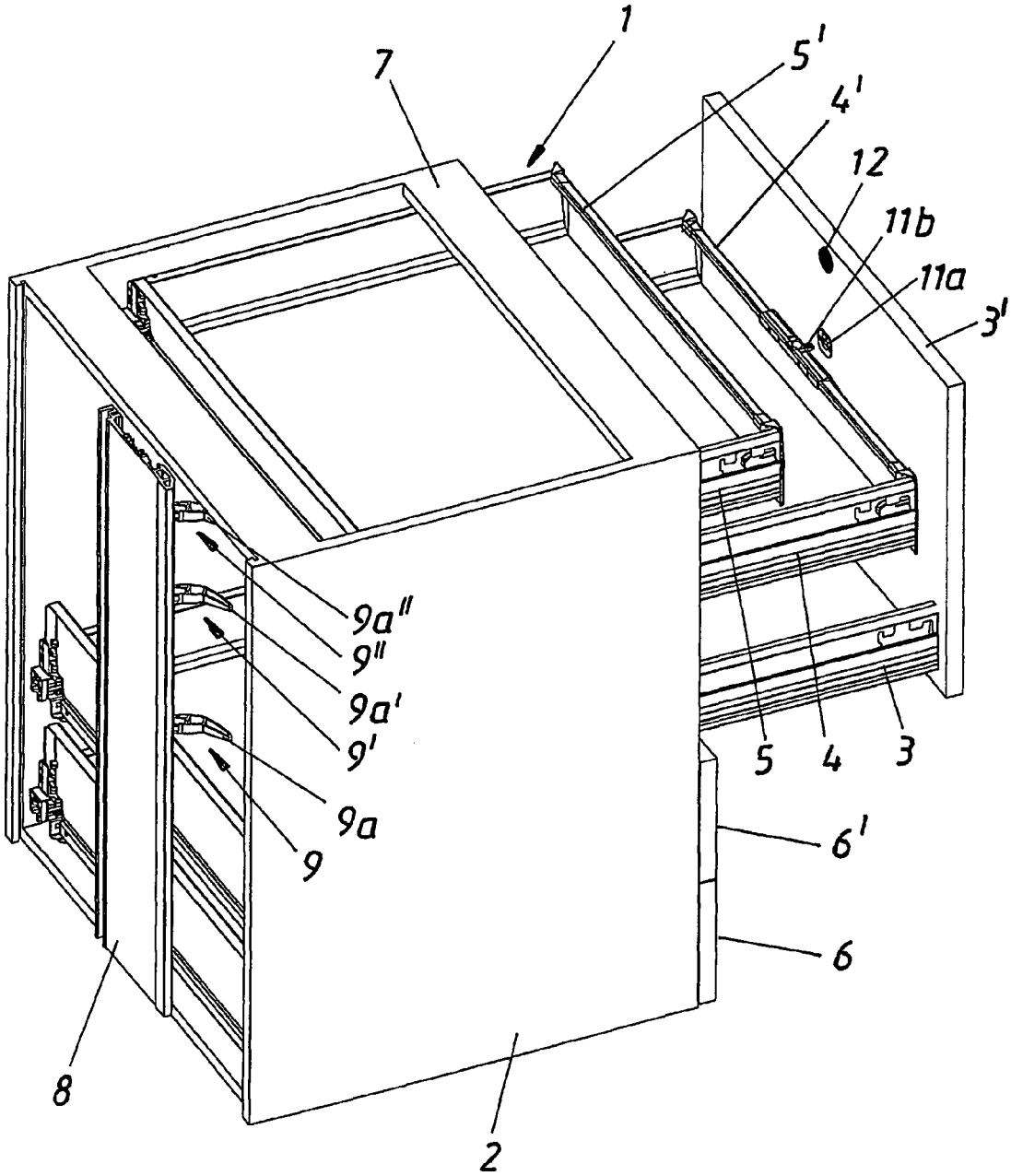
FIG. 2 shows a further embodiment of the invention with a releasable coupling device between the lower internal extension portion and the front extension portion and with a spring buffer between the upper internal extension portion and the front extension portion.

FIG. 2 shows a slight modification to the embodiment of FIG. 1. The structure of the article of furniture 1 is identical to that of FIG. 1, with the exception that no coupling option is provided for the upper internal extension portion 5 or the front wall 5' thereof, to the upwardly extended front panel 3' of the front extension portion 3. In the illustrated embodiment provided on the rear side of the front panel 3' of the front extension portion 3 is a spring buffer 12 which in the closed position of the two drawers 3 and 5 bears against the front wall 5' of the upper internal extension portion 5. In that way, the spring buffer 12 prevents unwanted panel impact in respect of the front panel 3' when the drawer 3 is closed. The spring buffer 12 can be replaced by a spacer portion preferably formed from a damping material with rubber-elastic properties.

Figure 3A:
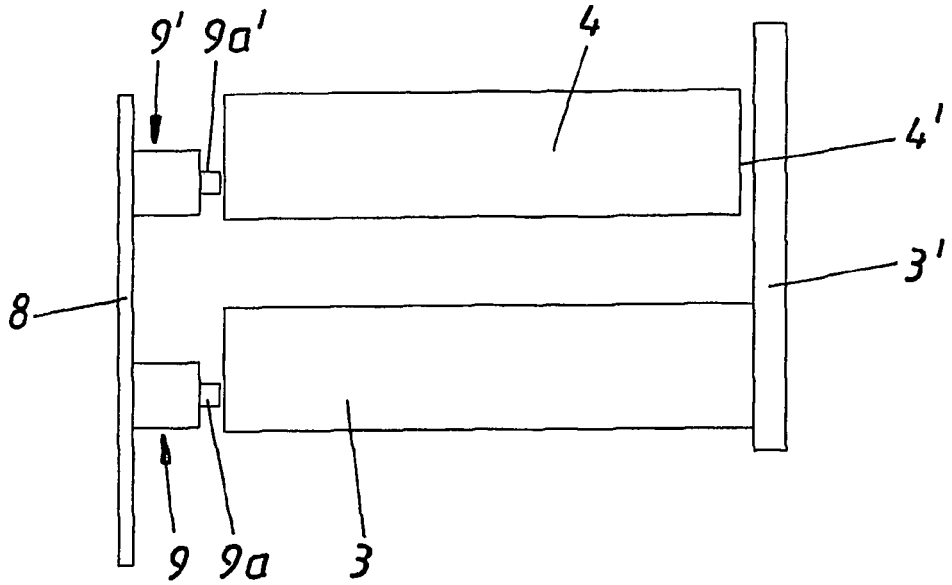
FIGS. 3*a*-3*d* show various embodiments of the triggering and coupling options between an internal extension portion and the front extension portion.

FIGS. 3*a*-3*d* show various embodiments of the triggering and coupling options by means of a simplified view of the front extension portion 3 and an internal extension portion 4, as a side view. FIG. 3*a* shows the front extension portion 3 with its upwardly extended front panel 3' which in the closed position of the drawers 3 and 4 substantially completely covers the front wall 4' of the internal extension portion 4. Provided at the rear wall 8 of the article of furniture 1 are two separate ejection devices 9 and 9', the ejection elements 9*a* and 9*a*' of which act on the respective drawer rear wall. In the illustrated embodiment, it is provided that the front extension portion 3 has a first limit position which corresponds to the closed position of the front extension portion 3 and that the front extension portion 3 is movable from that setting by the application of pressure in the closing direction thereof into a second limit position which is disposed inwardly of the carcass 2 so that the ejection element 9*a* of the ejection device 9 can be acted upon by pressure applied to the front extension portion 3. In the illustrated embodiment the ejection devices 9 and 9' are not coupled and there is not a releasable coupling option as between the front panel 3' and the front wall 4'. The opening process for the drawers 3, 4 takes place in mutually independent fashion, that is to say the internal extension portion 4 can only be extended after the front extension portion 3 has been deliberately moved into an open position by way of the ejection device 9. Subsequently, the internal extension portion 4 can be moved into the open position after separate activation of the ejection device 9'.

Figure 3B:
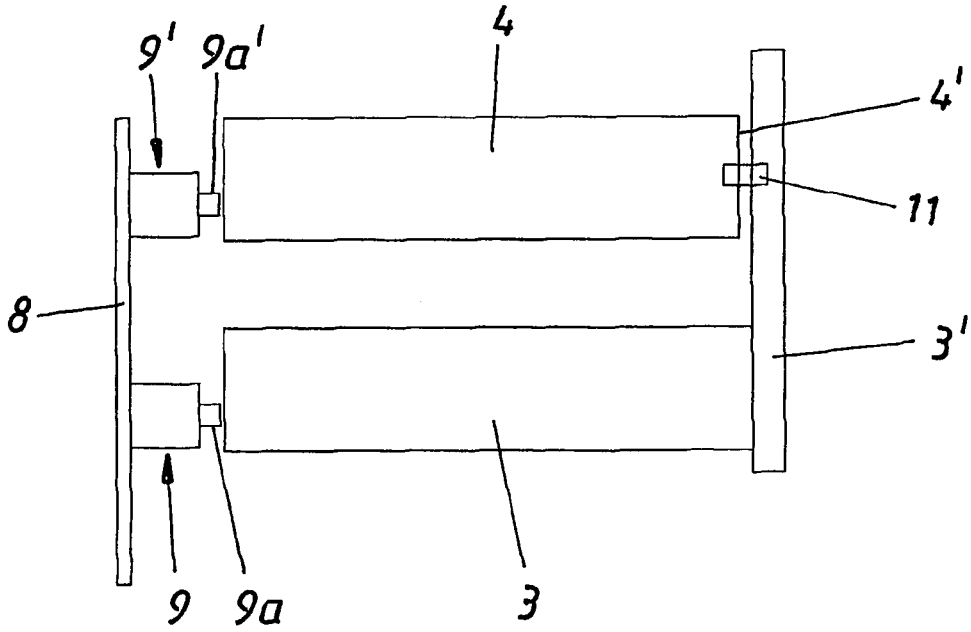

FIG. 3*b* shows an alternative embodiment of the invention as a side view. In contrast to FIG. 3*a*, the internal extension portion 4 or the front wall 4' thereof is coupled by way of a releasable coupling device 11 to the front panel 3' of the front extension portion 3. The releasable coupling device 11 comprises the entrainment element 11*b* shown in FIG. 1, and the coupling element 11*a*. The releasable coupling device 11 is preferably operative between the rear side of the front panel (3') of the first drawer (3) and between the front side (4') of the front panel or front wall of the at least second drawer (4) and preferably has two preselectable modes of operation, wherein in a first mode of operation the two drawers 3 and 4 are coupled together and in a further mode of operation they are not coupled. If the ejection device 9 of the front extension portion 3 is activated—for example by applying a manual pressure or pulling force to the front panel 3'—then the internal extension portion 4, in a situation involving active coupling of the releasable coupling device 11, moves together with the front extension portion 3 out of the carcass 2. If the releasable coupling device 11 is not active, separate activation of the internal extension portion 4 (also by applying pressure or a pulling force to the front panel 4') can be effected for moving it from its closed limit position into an open position.

Figure 3C:
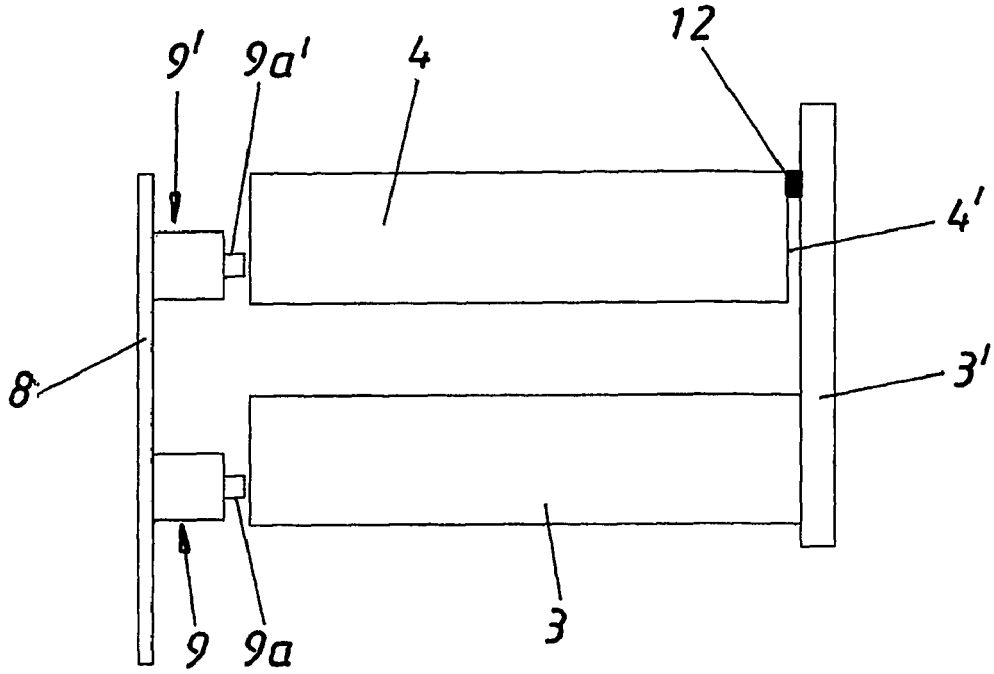

FIG. 3*c* shows a further embodiment of the invention. A spring buffer 12, as shown in FIG. 2, or a spacer portion is operative between the front panel 3' of the front extension portion 3 and the front wall 4' of the internal extension portion 4. When a pressure is applied to the front panel 3' the drawer 3—starting from the illustrated limit position corresponding to the closed position of the front extension portion 3—will be moved into a second limit position which is further into the carcass 2 so that pressure is also applied to the ejection element 9*a*. Pressure is also applied to the ejection element 9*a*' of the ejection device 9' by the spring buffer 12 or the spacer portion so that this leads to joint triggering of the two ejection devices 9 and 9'. In that case, it can be provided that when a pulling force is applied to the front panel 3', only the ejection device 9 of the front extension portion 3 is activated. The internal extension portion 4 can be activated independently of the front extension portion 3 by way of pressure or pulling pulses applied to its front panel 4'.

Figure 3D:
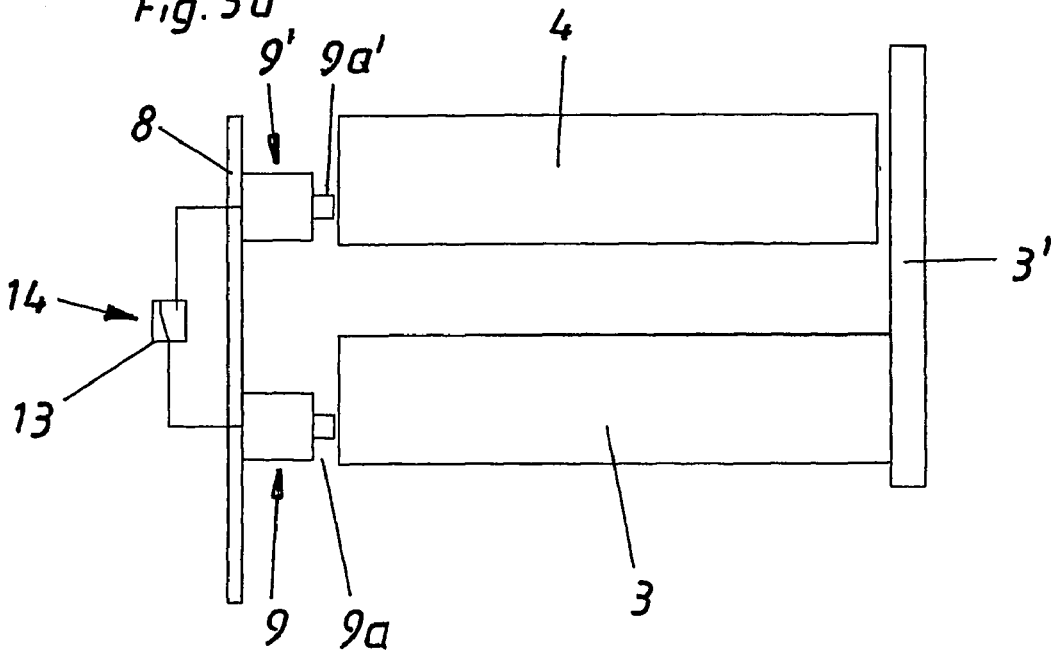

FIG. 3*d* shows a further embodiment of the invention. The illustrated Figure diagrammatically shows a switching element 13 operative between the two ejection devices 9 and 9'. The switching element 13 has at least two switching positions, wherein the switching element 13 couples the two drawers 3 and 4 in a first switching position and uncouples them in a second switching position. When the ejection device 8 of the front extension portion 3 is activated the internal extension portion 4 also moves or does not move with the front extension portion 3, depending on the respective switching position.

The switching element 13 can also be part of a program logic of a control and/or regulating device 14 by which the at least two ejection devices 9 and 9' are selectively controllable and actuatable. Various triggering pulses can be implemented by preferably manually applying a pulling and/or pressing force to the front panel 3' of the front extension portion 3. In that respect, it can be provided for example that the ejection device 9' of the internal extension portion 4 is not activated when pressure is preferably applied once to the front panel 3' of the front extension portion 3. In an advantageous development, it can also be the case that the ejection device 9' is activated upon preferably two successive applications of pressure to the front panel 3' of the front extension portion 3 within a predetermined or predeterminable period of time.

The invention is not limited to the illustrated embodiments by way of example but embraces or extends to all technical equivalents which can fall within the scope of the appended claims. The positional references adopted in the description such as for example up, down, lateral and so forth refer to the directly described and illustrated Figure and in the event of a change in position are to be correspondingly applied to the new position. The activation options described in respect of the individual ejection devices are to be interpreted only by way of example as a large number of further possible options are to be implemented for one of ordinary skill in the art concerned with the technical object here.

The invention claimed is:

1. An article of furniture comprising:

a furniture carcass, a first drawer and at least one second drawer being displaceable relative to said furniture carcass, said first drawer having a front panel and said at least one second drawer having a front panel or a front wall;

wherein in a closed position of said first drawer and said at least one second drawer said front panel of said first drawer substantially completely covers said front panel or said front wall of said at least one second drawer, said first drawer and at least one of said at least one second drawer each having an ejection device for moving said first drawer and said at least one of said at least one second drawer, respectively, from the closed position into an open position; and a switching element which, when in a first switching position, couples the ejection device of said first drawer and one or more of the ejection devices of said at least one of said at least one second drawer such that when either the ejection device of said first drawer or any of the one or more ejection devices of said at least one of said at least one second drawer is triggered, said first drawer and said at least one of said at least one second drawer having the one or more ejection devices, respectively, are moved from the closed position into the open position, and, when in a second switching position uncouples the ejection device of said first drawer and the one or more ejection devices of said at least one of said at least one second drawer such that when either the ejection device of said first drawer or any of the one or more ejection devices of said at least one of said at least one second drawer is triggered, either said first drawer or said at least one of said at least one second drawer having the one or more ejection devices, respectively, is moved from the closed position into the open position, respectively.

2. The article of furniture according to claim 1, wherein at least one of said ejection devices has a drive device which includes an ejection element for ejecting at least one of said first drawer and said at least one of at least one second drawer.

3. The article of furniture according to claim 2, wherein said drive device comprises at least one spring.

4. The article of furniture according to claim 1, wherein said ejection device of said first drawer and said ejection device of said at least one of said at least one second drawer are coupled so that said ejection device of said first drawer is configured to trigger said ejection device of said at least one of said at least one second drawer.

5. The article of furniture according to claim 1, wherein said first drawer has a first limit position which corresponds to the closed position of said first drawer and said first drawer is movable starting from the first limit position by application of pressure in a closing direction of said first drawer into a second limit position which is further into said furniture carcass.

6. The article of furniture according to claim 5, wherein said ejection device of said first drawer is configured to move said first drawer from the second limit position into the open position.

7. The article of furniture according to claim 1, wherein said first drawer has a limit position which corresponds to the closed position of said first drawer and said first drawer is movable starting from the limit position by application of a pulling force into the open position, and said ejection device of said first drawer is inactive in the open position of said first drawer.

8. The article of furniture as according to claim 1, further comprising a control and regulating device for selectively moving said first drawer and said at least one of said at least one second drawer.

9. The article of furniture according to claim 8, wherein at least one of the ejection device of said first drawer and the ejection device of said at least one of said at least one second drawer comprises at least one electric switch which is activated by application of a pulling force or a pushing force to said first drawer or said at least one of said at least one second drawer, respectively, wherein signals from said at least one switch are passed to said control and regulating device.

10. The article of furniture according to claim 8, wherein said control and regulating device does not activate said ejection device of said at least one of said at least one second drawer when a pressure is applied once to said first drawer.

11. The article of furniture according to claim 8, wherein said control and regulating device activates said ejection device of said at least one of said at least one second drawer when pressure is applied at least twice in succession to said first drawer within a predetermined period of time.

12. The article of furniture according to claim 8, wherein said control and regulating device does not activate said ejection device of the first drawer or the ejection device of said at least one of said at least one second drawer when a pulling force is applied to said first drawer.

13. The article of furniture according to claim 2, wherein the drive device comprises at least one electric motor.

14. The article of furniture according to claim 1, wherein said switching element has $2^n$ number of switching positions, in which n is the number of the ejection devices of said at least one of said at least one second drawer, and said switching element is operable to couple the ejection device of said first drawer and any combination of one or more of the ejection devices of said at least one of said at least one second drawer.

* * * * *